US005574486A

United States Patent [19]

Whitlow et al.

[11] Patent Number: 5,574,486

[45] Date of Patent: Nov. 12, 1996

[54] INK JET PRINT HEADS AND METHOS FOR PREPARING THEM

[75] Inventors: Maridana L. Whitlow; J. Kirk McGlothlan, both of Beaverton, Oreg.; Jeffrey J. Anderson, Camas, Wash.; Randy C. Karambelas, Beaverton; Richard Schmachtenberg, III, Aloha, both of Oreg.

[73] Assignee: Tektronix, Inc., Wilsonville, Oreg.

[21] Appl. No.: 3,917

[22] Filed: Jan. 13, 1993

[51] Int. Cl.[6] ..... B41J 2/16

[52] U.S. Cl. ..... 347/45; 347/47; 347/70; 205/646; 205/661; 205/684

[58] Field of Search ..... 346/140, 75, 1.1; 347/45, 47, 70, 71; 204/129.1

[56] References Cited

U.S. PATENT DOCUMENTS

| | | | |
|---|---|---|---|
| 2,868,705 | 1/1959 | Baier et al. . | |
| 4,314,259 | 2/1982 | Cairns et al. | 346/75 |
| 4,403,234 | 9/1983 | Miura | 347/47 X |
| 4,454,519 | 6/1984 | Oosaka et al. | 346/140 R |
| 4,563,257 | 1/1986 | Sova | 204/129.85 |
| 4,578,164 | 3/1986 | Matsui | 204/129.55 |
| 4,692,284 | 9/1987 | Braden | 264/4.3 |
| 4,869,430 | 9/1989 | Good | 239/524 |
| 5,066,370 | 11/1991 | Andreshak et al. | 204/129.1 |
| 5,087,930 | 2/1992 | Roy | 347/71 X |
| 5,096,550 | 3/1992 | Mayer et al. | 204/129.1 |
| 5,406,318 | 4/1995 | Moore et al. | 347/70 |

FOREIGN PATENT DOCUMENTS

| | | | |
|---|---|---|---|
| 0177316 | 9/1985 | European Pat. Off. | B41J 3/04 |
| 58-89370 | 5/1983 | Japan | B41J 3/04 |
| 176054 | 10/1984 | Japan | B41J 3/04 |
| 61-25852 | 2/1986 | Japan | B41J 3/04 |
| 25852 | 2/1986 | Japan | R41J 3/04 |

OTHER PUBLICATIONS

15 *Kirk–Othmer Encyclopedia of Chemical Technology*, 302–03 (3d ed., New York, John Wiley & Sons, 1981).

*Primary Examiner*—Joseph W. Hartary
*Attorney, Agent, or Firm*—Ralph D'Alessandro; Mark M. Meininger

[57] ABSTRACT

The present invention provides an ink jet print head capable of fast, efficient and consistent printing. Such ink jet print heads include an ink ejecting component which incorporates electropolished surfaces. Electropolishing techniques useful in the production of such ink ejecting components are also discussed.

11 Claims, 5 Drawing Sheets

INK JET PRINT HEADS AND METHOS FOR PREPARING THEM

TECHNICAL FIELD

The present invention relates to ink jet print heads of increased printing efficiency and consistency. More particularly, the present invention relates to ink jet print heads incorporating ink injection mechanisms, which include orifices or orifice plates exhibiting a reduced surface defect density.

BACKGROUND OF THE INVENTION

Ink jet printers, in particular drop-on-demand (DOD) or impulse printers having ink jet print heads with acoustic drivers to accomplish ink drop formation, are well known in the art. Some ink jet print heads eject ink from the print head in a direction perpendicular to the plane of one or more ink pressure chambers, and other print heads eject ink in a direction parallel to the plane of one or more ink pressure chambers.

The principle underlying the successful operation of an ink jet print head of the DOD type is the manipulation of pressure within an ink pressure chamber to achieve controlled emission of ink droplets from the print head through one or more orifices. In general, a DOD ink jet print head, having an ink pressure chamber coupled to a source of ink and an ink drop ejecting orifice, is operated as set forth below. An acoustic driver expands and contracts the volume of the ink pressure chamber to eject a drop of ink from the orifice. The acoustic driver applies a pressure wave to ink residing within the ink pressure chamber to cause the ink to pass outwardly through the orifice in a controlled manner.

Ink jet print heads generally have a layered structure including a plate having a plurality of orifices through which ink is deposited onto a print medium. The structure of this orifice plate is important to the efficiency of the print head and the quality of printed images produced thereby. During the orifice plate manufacturing process, burrs or other surface defects are sometimes formed at the edges of orifices. Such defects impede the flow of ink through the orifice plate and can cause "off-axis shooting" (i.e., deposition of ink onto the print medium at a location that is not aligned with the orifice). In addition, such defects can cause the effective orifice size to decrease by obstructing some portion thereof. Such obstruction results in slowed, inefficient ink droplet deposition.

Off-axis shooting is a problem that affects the print image's quality and manifests itself in several ways. Since the ink or coloring agent can be directed to a spot on the target media offline from the intended strike location, some areas of the target media can be uncolored, appearing as white spots that give the appearance to the naked eye of bands in the printed image. Lines in the printed image can also be printed in a form that is not straight, appearing as wiggly or fuzzy lines. These manifestations can also be created by the formation of satellite drops of ink as the ink is ejected from the nozzles of the ink jets with surface defects, resulting in the formation of multiple droplets that impact the target medium in an unintended and undesired pattern.

Another manifestation of the off-axis shooting problem is the change in the shading of the secondary colors of the printed image because of either the lack of a drop of ink of a particular color or different volumes of inks of a specific color being delivered to different locations on the printed image.

Similarly, off-axis shooting can be caused by the orifices being obstructed during operation or maintenance of the print head. For example, small slivers of metal, as small as 5 microns, on the surface of an 80 micron nozzle orifice as a result of the fabrication process can serve directly to obstruct the nozzle orifice, especially when oriented along the axis of the orifice opening, or indirectly can cause obstructions as nucleation sites for the growth of ink crystals because inks of different colors are sometimes incompatible and form a solid precipitate when mixed together. Such mixing can occur inadvertently during a print head maintenance procedure in which a wiper blade moves across the print head, mixing together all of the inks. The mixture of incompatible inks, for example black and magenta, can be held in place on the small surface defects and continue to build up during continued operation of the printer. Since oxygen is essential for crystal growth and the print head is exposed to air, the build-up can continue until it results in the formation of sufficient solids that can cause off-axis shooting or ultimately in a catastrophic failure of the print head.

These problems are solved in the print head design and process of treating the orifice plate in the print head design of the present invention.

SUMMARY OF THE INVENTION

The present invention provides ink jet print heads capable of fast, efficient and consistent printing. Such improved printing can be maintained over an extended period of time. The present invention also provides methods for making an ink jet print head capable of efficient and consistent printing.

Ink jet print heads of the present invention include an ink ejecting component which incorporates an electropolished ink-contacting or orifice surface on the outlet side of the print head. For example, embodiments of the present invention include ink jet print heads with electropolished orifice plates. A major surface of the orifice plate or a portion thereof, such as some or all of the ink-contacting surface area on the outlet side of the print head, may be electropolished. Such electropolishing produces orifice plates which exhibit a reduced number of surface defects, such as burrs. Similarly, electropolishing an orifice plate major surface area opposite the ink-contacting surface area on the outlet side of the print head reduces surface defects that facilitate the formation of solid precipitates caused by mixed incompatible inks. These surface defects also can damage the ink jet print head maintenance equipment, such as silicon wipers. The reduction in surface defects and precipitates results in a decrease in off-axis shooting caused by the deflection or other misdirection of the ink droplets passing through the orifices.

The benefits of the present invention are therefore achieved through the simple process of electropolishing one component of the ink jet print head (e.g., the orifice plate or a portion thereof on the outlet side). Electropolishing is conducted prior to ink jet print head assembly. As a result, no contaminants are introduced into the print head and no clogging of small cross-section ink passages takes place. Further, no acoustic energy-absorbing materials are introduced during electropolishing. Electropolishing reduces the density of surface defects on the ink-contacting or orifice surfaces of the ink ejection means and, it is believed, the density on the opposite surface of nucleation sites for the formation of mixed ink precipitates. This reduction in surface defect density and nucleation site density substantially reduces print quality degradation resulting from off-axis shooting and other printing inefficiencies introduced by such defects. Moreover, electropolishing as little as from about 1 to about 2 micrometers of the ink ejection means orifice or other ink-contacting surface provides a component for use in a print head capable of reliable operation during production of thousands of copies.

The present invention also provides an improved electropolishing method for use in production of ink jet print heads or components thereof. Electropolishing using an electropolishing bath in accordance with the present invention results in a more uniformly polished surface (e.g., reduced bubble tracks) upon application of lower current densities. Such electropolishing method embodiments preferably involve an electropolishing bath which includes Fluorad® FC 95 surfactant.

BRIEF DESCRIPTION OF THE DRAWINGS

Additional features and advantages of the present invention will be apparent from the following detailed description of preferred embodiments thereof, which proceeds with reference to the accompanying drawings, in which.

DETAILED DESCRIPTION OF PREFERRED EMBODIMENTS

While the present invention is described below with reference to a drop-on-demand (DOD) ink jet print head, a practitioner in the art will recognize that the principles of the present invention have applicability with respect to other ink jet print heads.

Figure 1:
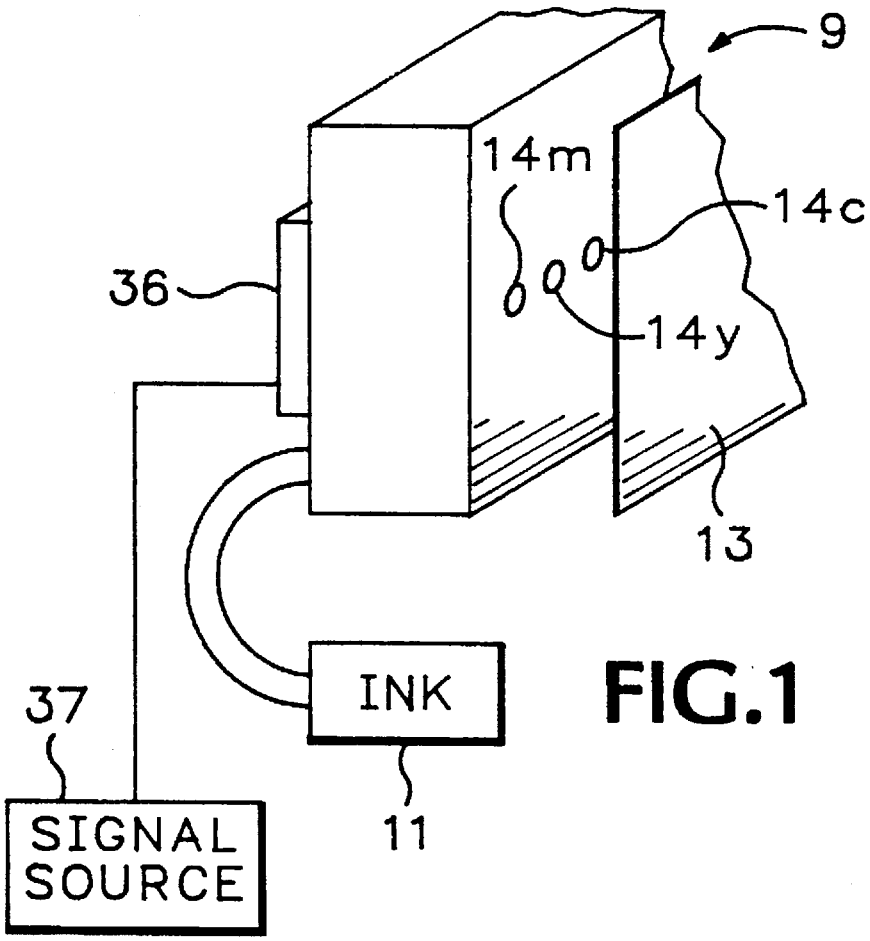
FIG. 1 is a schematic perspective view of an embodiment of an ink jet print head of the present invention, with a print medium shown spaced therefrom.
Figure 2:
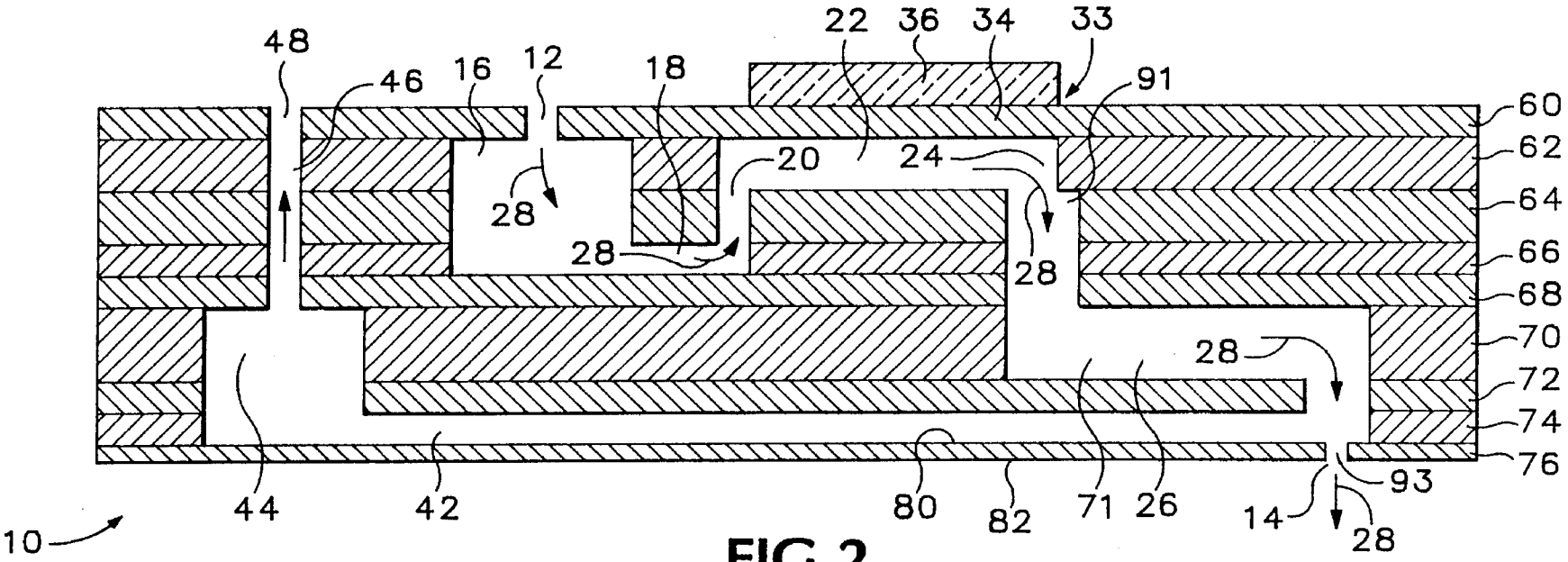
FIG. 2 is a diagrammatic cross-sectional view of a single jet of an embodiment of an ink jet print head of the present invention.

With reference to FIGS. 1 and 2, a DOD ink jet print head 9 has a body 10 which includes one or more ink pressure chambers 22 coupled to or in communication with one or more ink sources 11. Ink jet print head 9 has one or more ink ejection means such as orifices or nozzle/outlets 14, of which nozzle/outlets 14*c*, 14*m*, and 14*y* are shown. Each nozzle/outlet 14 is coupled to or in communication with an ink pressure chamber 22 by way of an ink passage 26. Ink passes through nozzle/outlet 14 during ink drop formation. Ink drops travel in a direction along a path from nozzle/outlets 14 toward a print medium 13, which is spaced from nozzle/outlets 14. A typical ink jet printer includes a plurality of ink pressure chambers 22, with each such pressure chamber 22 coupled to one or more nozzle/outlets 14.

An acoustic drive mechanism 33 is utilized for generating a pressure wave or pulse, which is applied to the ink within ink pressure chamber 22 to cause ink to pass outwardly through an associated nozzle/outlet 14. Acoustic driver 33, including, for example, a piezoelectric ceramic portion 36 (FIG. 2) and a diaphragm 34 (FIG. 2), operates in response to signals from a signal source 37 to cause pressure wave application to the ink.

Figure 3A:
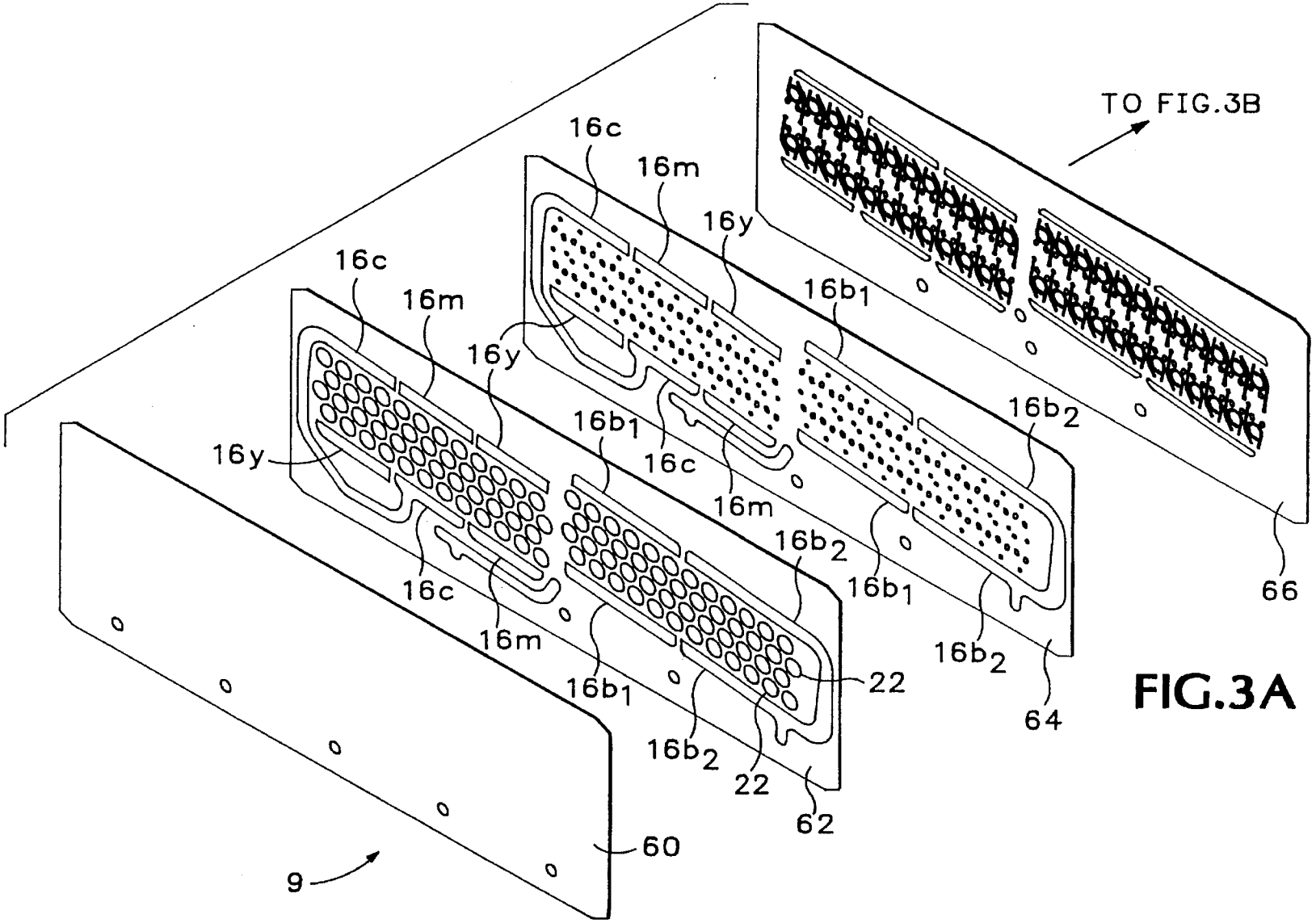
FIG. 3 is an exploded isometric view of an ink jet print head of the present invention employing ninety-six orifices.
Figure 3B:
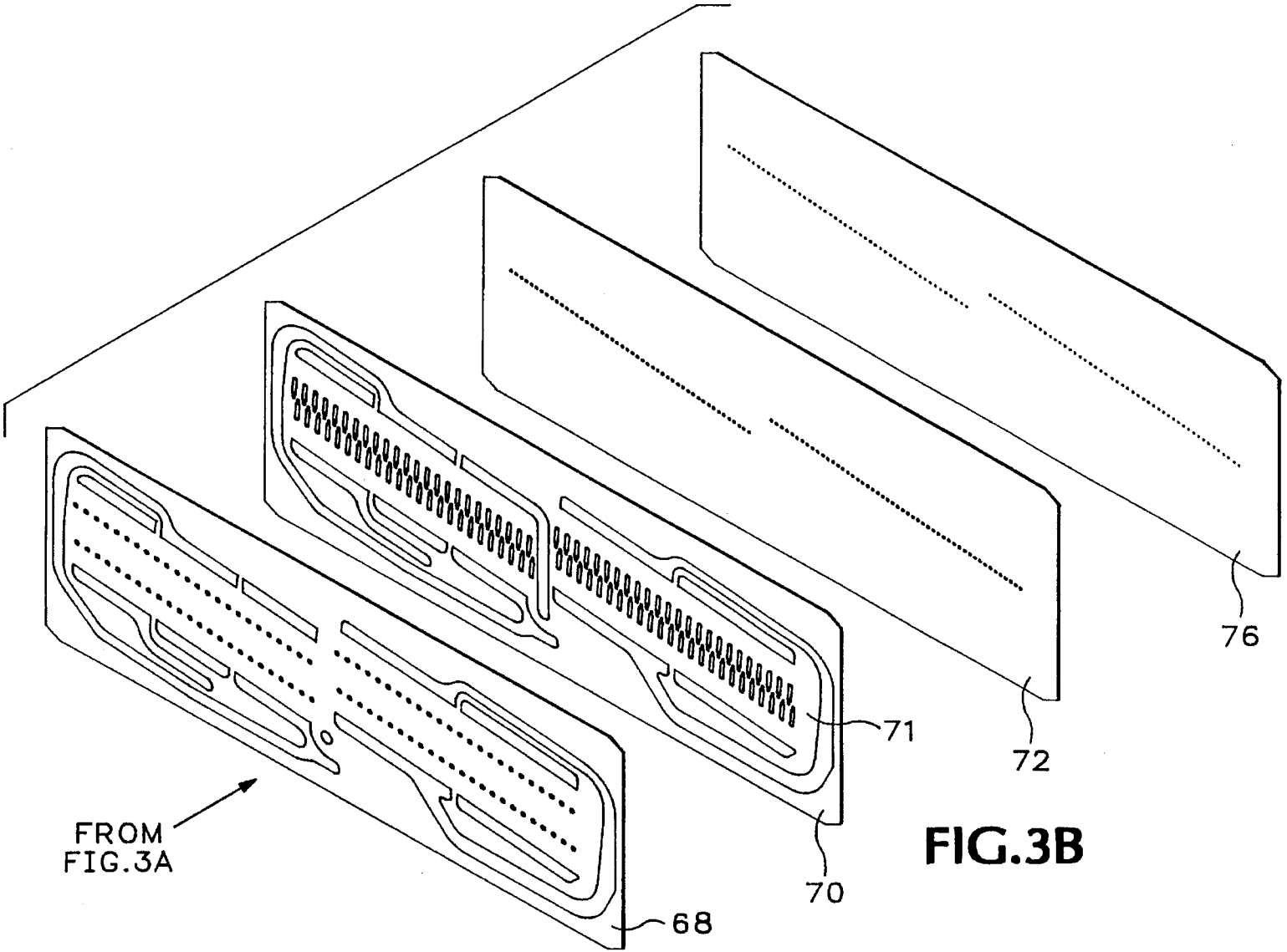
Figure 4:
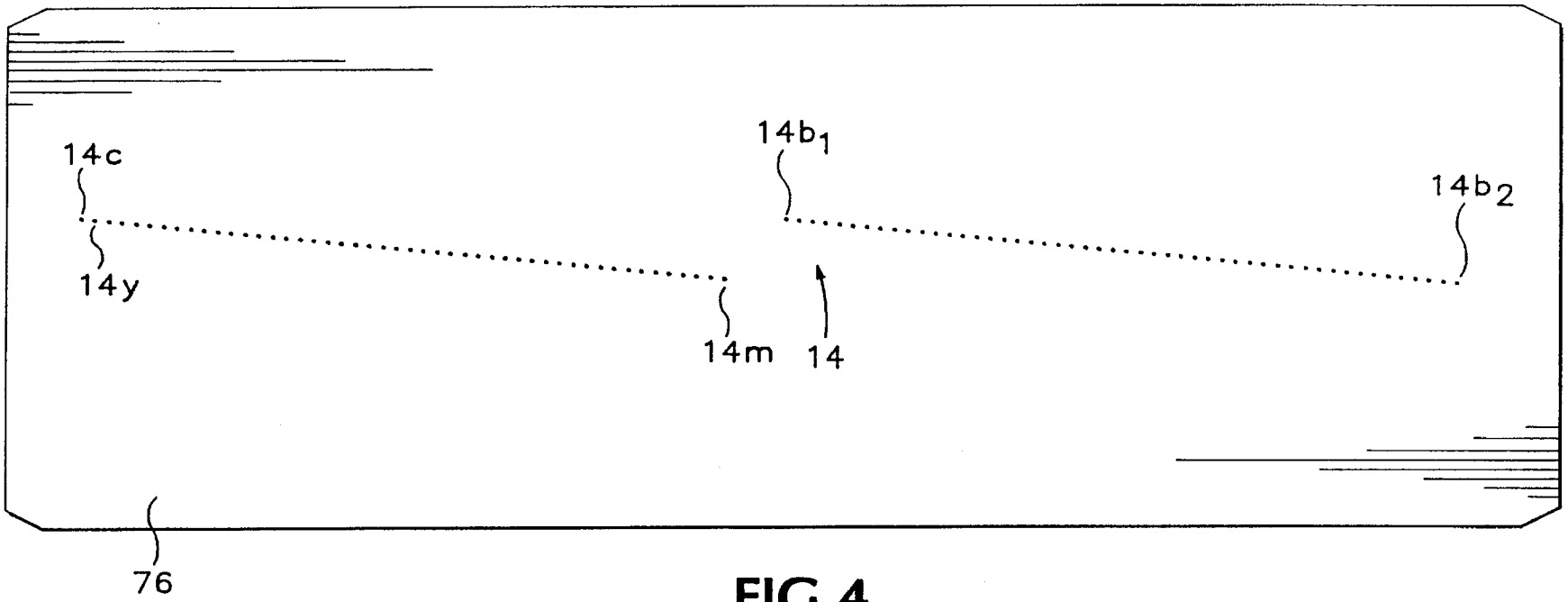
FIG. 4 is an enlarged rear view of an orifice plate useful in the ink jet print head embodiment shown in FIG. 3.

Nozzle/outlets 14 of an embodiment of the ink ejection means of the present invention may be formed in an orifice plate 76 contained in body 10 on the outlet side of ink jet print head 9. An exemplary orifice plate 76 is shown in FIGS. 3 and 4. In accordance with the present invention, a major surface of or a portion of the orifice plate 76 surface on the outlet side of the assembled print head is electropolished to provide an improved ink ejection means.

The entire surface of orifice plate 76 may be immersed in, as well as exposed to, an electropolishing bath as described in greater detail below. Alternatively, masking or another blocking technique may be employed to achieve exposure of less than all of the orifice plate 76 surface to an electropolishing bath. Preferably, a major surface of nozzle/outlets 14 is exposed to the electropolishing bath. Alternatively, orifice plate 76 surface area in the vicinity of each nozzle/outlet 14 may additionally be exposed to an electropolishing bath.

Orifice plates 76 may be of any composition or construction capable of ejecting an ink droplet of desired size onto print medium 13. Nozzle/orifice 14 dimensions are dependent, in part, upon the desired ink droplet size. Nozzle/outlet 14 diameters ranging from 35 to 85 microns have been used successfully, although useful nozzle/outlet 14 dimensions are not limited to this range. For printing with aqueous based inks at 300 dots per inch, a preferred nozzle/outlet 14 diameter is about 35 microns. For printing with hot melt or phase change inks at 300 dots per inch, because of the limited spreading of the ink drops on print medium 13, a preferred nozzle/outlet 14 diameter is between about 50 and 80 microns. In both of these instances, a preferred thickness of orifice plate 76 is about 50 to 75 microns or 0.0020 to 0.0030 inch. Orifice plate 76 may be composed of a stainless steel sheet of about 75 microns thickness plated with about 0.125 microns of gold or other material. Generally, electropolishing in accordance with the present invention occurs prior to such plating.

Orifice plates 76 of a variety of shapes having a variety of nozzle/outlet 14 configurations may be employed in the practice of the present invention, but orifice plates of substantially square or rectangular shapes are preferred for ease of manufacture. FIG. 4, for example, depicts orifice plate 76 with nozzle/outlets 14 arranged as two horizontally offset, substantially straight line rows. This illustrated configuration can be readily modified to a single line arrangement. None of the operating characteristics of ink jet print head 9 are affected by such a modification.

The optimal orifice plate 76 configuration as well as the color pattern of nozzle/outlets 14 depend, in part, upon the configuration of the manifold and pressure chamber networks of print head 9. The network configurations, in turn, depend upon the color printing capability of the print head (e.g., black and/or color subtractive printing, black and/or less than the full range of color subtractive printing, black and/or the full range of color subtractive printing and additional colors for direct ejection, black and/or direct deposit colors or the like).

Preferably, orifice plates 76 are composed of stainless steel, although other materials meeting the aforementioned criteria, such as nickel, copper, aluminum and the like may also be used. Orifice plates 76 may be stainless steel selectively plated with a braze material such as gold, with the electropolishing occurring prior to plating. Electropolishing may be conducted only to the extent necessary to remove surface defects such as burrs from an ink-contacting surface 80 of orifice plate 76, or to treat an opposed surface 82 of orifice plate 76 so as to prevent formation of mixed ink precipitates and improve print head maintenance, or to treat both surfaces 80 and 82. The following description is ink-contacting surface 80, but is similarly applicable to the electropolishing of surface 82.

Orifice plates 76 useful in the practice of the present invention have been made successfully using a variety of processes including punching, micro-electric discharge machining, and laser drilling three hundred series stainless steel. These approaches are generally used in concert with photo-patterning and etching all of the features of orifice plate 76 except nozzle/outlets 14 themselves. Another approach is to use a standard blanking process to form the rest of the features in orifice plate 76.

The processing of orifice plates 76 may be accomplished using conventional techniques therefor. In general, an orifice plate 76 is processed as follows to provide components to be included in ink jet print heads 9 of the present invention. After formation of the nozzles/outlets in the orifice plate 76, orifice plate 76 is prewet with wetting agents, such as isopropyl alcohol and water, and placed in operable connection with an electropolishing fixture. Electropolishing of the exposed stainless steel portion of orifice plate 76 is conducted, the sheet is cut, for example, into 1.3"×3.8" (3.3 cm×9.7 cm) orifice plates 76, and the orifice plates 76 are cleaned. Ink jet print head 9 of the present invention is then assembled.

An exemplary electropolishing process useful in the practice of the present invention employs conventional electropolishing equipment, including both fixtures and power supply (e.g., Pulser Model No. 100204 available from Pulsco, Inc., Andover, Mass.). A stock solution is formed with about 2.67 grams of Fluorad® FC 95 fluorochemical surfactant, available from Minnesota Mining and Manufacturing Co., of Minneapolis, Minnesota admixed with about 400 ml of concentrated, reagent grade phosphoric acid in a polypropylene bottle. This Fluorad® surfactant stock solution is then stored until needed in preparation of an electropolishing bath.

An electropolishing bath is prepared by admixing about 5 gallons of reagent grade phosphoric acid, about 1.2 gallons of reagent grade sulfuric acid, and about 90 ml of the Fluorad® surfactant stock solution to achieve an appropriate concentration of Fluorad® FC 95 surfactant, with a concentration of between about 20 ppm and about 50 ppm Fluorad® FC 95 surfactant in the electropolishing bath preferred. The concentration of Fluorad® FC 95 surfactant is preferably checked periodically during electropolishing, such as with a surface tension device, to ensure that an appropriate concentration level is maintained. To ensure there is the proper acid concentration in the solution, the specific gravity of the bath is also periodically checked. Distilled water can be added, as necessary, to maintain the specific gravity within the desired range of between about 1.6 and about 1.8 and, more preferably, about 1.672. The addition of water to the bath also helps to control the proper ionic conductivity of the bath to keep it within a desired range of between about 50 to about 60 amps. Heat is applied to the electropolishing bath to bring the bath temperature to about 53° C. Nitrogen may be sparged into the bath to keep the solution mixed.

Orifice plates 76 preferably are examined to ensure that the area to be electropolished is substantially free from dents. Also, the electropolishing equipment should be examined to assure that the negative lead from the power supply is attached to the anode plate of the electropolishing fixture.

To properly electropolish the relevant portion of the orifice plate 76 surface, an appropriate amount of current must be employed for an appropriate amount of time. For example, surfaces 80 of orifice plates 76 of the preferred dimensions discussed above may be electropolished in groups of seven. Such a group may be polished by the application of 49 ampere-minutes of current. In other words, about 7 ampere-minutes of current is required to electropolish each orifice plate 76. Preferably, a group of seven orifice plates 76 is polished with a pulsed power supply providing a 50 ampere pulse that is on for 9.0 msec, followed by a 10 msec off cycle. The pulse power supply is set to provide 49 ampere-minutes of current over a period of about 18 seconds for each orifice plate 76.

The electropolishing of surfaces 80 of the group of orifice plates 76 may extend over periods ranging from the preferred 18 seconds up to about 90 seconds. For example, an electropolishing period of 18 seconds results in substantially reducing the burrs without changing the diameter of nozzles/outlets 14. An electropolishing period of 50 seconds results in complete removal of surface defects, such as slag or burrs, with the diameters of nozzles/outlets 14 increasing from about 8% to about 0% from surface 80 to about 40% into nozzles/outlets 14, respectively.

An electroplishing period of about 71 seconds is substantially similar to a period of 50 seconds, except that the increased diameters of nozzles/outlets 14 extend about 60% therein. The electropolishing of surface 82 of orifice plate 76 can extend over periods of between 5 and 20 seconds to suitably prevent formation of mixed ink precipitates and improve print head maintenance.

Orifice plates 76 are inserted into a conventional electropolishing fixture and attached to a backing plate component of the fixture by any convenient means, such as an alligator clip. Other conventional fastening means may be alternatively employed for this purpose. It is preferred to have the orifice plates 76 abut the backing plate substantially along the entire length of orifice plate 76. Preferably, the fixturing is conducted such that a current thief is provided at the major surface of orifice plate 76 facing the fixture and, more preferably, at the surface in the vicinity of each orifice and facing the fixture to obtain uniform lines of flux within the bath.

The anode and orifice plate 76/backing plate are completely submerged in the electropolishing bath. The electropolishing current is applied to the exposed portion or portions of the orifice plate 76 surface for the electropolishing time as discussed above. Improved electropolishing is obtained by positioning the orifice plate 76 nearer the top of the bath tank than nearer the bottom.

After current application, orifice plate 76 is removed from the electropolishing bath and is dipped in and stirred within one or more, preferably two, rinse tanks filled with deionized (DI) water. After rinsing, orifice plate 76 is preferably carefully sprayed with a DI water mister or spritzer. In this manner, residual acid from the electropolishing bath is removed from orifice plate 76. Preferably, orifice plate 76 is then carefully blow dried.

Any other electropolishing or orifice plate 76 treatment process may be employed in the practice of the present invention. When considered together, such alternative processes should achieve the same or similar reduction in surface defect density. A practitioner in the art would be able to design as well as implement appropriate electropolishing and orifice plate 76 treatment procedures.

Orifice plates 76 treated in accordance with the present invention are preferably deployed within ink jet print heads 9. Ink jet body 10 defines an ink inlet 12 through which ink is delivered to ink jet print head 9 (FIG. 1). Body 10 also defines nozzle/outlet 14 and an ink flow path 28 from ink inlet 12 to nozzle/outlet 14. In general, ink jet print head 9 preferably includes an array of nozzle/outlets 14 which are proximately disposed (i.e., closely spaced from one another) for use in printing drops of ink onto print medium 13 (FIG. 1).

FIG. 3 illustrates an exemplary orifice plate 76 useful in ink jet print head 9 as shown in FIG. 3. This embodiment of ink jet print head 9 is designed with multiple ink receiving manifolds which are capable of receiving various colors of ink and form the manifold network. The illustrated embodiment has five sets of manifolds (16*c*, 16*m*, 16*y*, 16*b*$_1$ and 16*b*$_2$), each set including two manifold sections. The manifold sets are isolated from one another such that the ink jet print head can receive five distinct colors of ink. Ink jet print head 9 of this embodiment can therefore receive cyan, yellow, magenta and black inks for use in black plus full color subtractive printing. A fifth color of ink could alternatively be used, rather than printing that color by combining cyan, yellow and magenta inks on the print medium.

Nozzle/outlets 14 have a central axis which is generally normal to the plane of ink pressure chambers 22 associated therewith. In addition, the central axes of the nozzle/outlets, if extended to intersect the plane of pressure chambers 22, are offset from and do not intersect the associated pressure chambers 22.

Referring to FIGS. 3 and 4, the 48 nozzle/outlets 14 in the right-hand row on orifice plate 76 are supplied with black ink. The left hand row of nozzle/outlets 14 is supplied with interleaved colors of ink. That is, adjacent nozzle/outlets 14 in the left-hand row are each supplied with a different color of ink. This facilitates color printing as the vertical spacing between nozzle/outlets 14 of a given color of ink is at least two addresses apart. Manifolding and ink supply arrangements can be easily modified to alter the interleaved arrangement of nozzle/outlet 14 colors as desired.

The center-to-center spacing of nozzle/outlets 14 during operation of ink jet print head 9 as shown in FIGS. 3 and 4 is preferably about 0.0335 inch (0.85 mm). At the preferred spacing, if a line of nozzle/outlets 14 is rotated from horizontal through an angle whose arctangent is $1/10$, the vertical distance between adjacent nozzle/outlets 14 is $1/300$ inch and the corresponding horizontal spacing is $10/300$ inch. At these horizontal and vertical spacings, ink jet print head 9 prints at an addressability of 300 dots per inch in both the horizontal and vertical directions.

Close center-to-center nozzle/outlet 14 spacing depends, in part, upon the configuration of ink passages 26. In general, each passage 26 is composed of a first section 91 extending in a direction normal to the plane of pressure chambers 22 for a first distance, a second offset channel section 71 extending in a second direction parallel to the plane of pressure chambers 22 for a second distance, and a third section 93 extending normal to the second direction and to the nozzle/outlet 14. Offset channel portion 71 enables the alignment of nozzle/outlets 14 in one or more rows with the center-to-center nozzle/outlet 14 spacing much smaller than that of the associated pressure chambers 22. Moreover, each orifice plate 76 is operably connectable to a separator plate 72 or an outlet plate 74 (not shown in FIG. 3) such that nozzle/outlets 14 communicate with a corresponding ink pressure chamber 22 and eject ink in response to a deflection of an appropriate piezoelectric ceramic 36.

To facilitate manufacture of ink jet print heads 9 in accordance with the present invention, body 10 is preferably formed of plural laminated plates or sheets fabricated, for example, from stainless steel. These sheets are stacked in a superposed relationship. In the single jet embodiment of print head 9 illustrated in FIG. 2, these sheets or plates include a diaphragm plate 60, which forms diaphragm 34 and also defines ink inlet 12 and a purging outlet 48; an ink pressure chamber plate 62, which defines ink pressure chamber 22, a portion of an ink supply manifold 16, and a portion of a purging passage 46; a separator plate 64, which defines a portion of an ink passage 26, bounds one side of pressure chamber 22, defines an inlet 20 and an outlet 24 to pressure chamber 22, defines a portion of supply manifold 16 and also defines a portion of purging passage 46; an ink inlet plate 66, which defines a portion of passage 26, an inlet channel 18, and a portion of purging passage 46; another separator plate 68, which defines portions of passages 26 and 46; an offset channel plate 70, which defines a major or offset portion 71 of passage 26 and a portion of a purging manifold 44; a separator plate 72, which defines portions of passage 26 and purging manifold 44; an optional outlet plate 74, which defines a purging channel 42 and a portion of purging manifold 44; and orifice plate 76, which defines nozzle/outlets 14 of the array.

More or fewer plates than illustrated may be used to define the various components of ink jet print head 9. For example, multiple plates may be used to define ink pressure chamber 22 instead of the single plate illustrated. Also, not all of the various features need be included in separate sheets or layers of metal. For example, patterns in the photoresist that are used as templates for chemically etching the metal (if chemical etching is used in manufacturing) could be different on each side of a metal sheet. More specifically, the pattern for ink inlet 20 could be on one side of a metal sheet and the pattern for pressure chamber 22 could be on the in registration front-to-back, for example. With careful etching control, separate ink inlet 20 and pressure chamber 22 containing metallic layers could therefore be combined into a single layer.

To minimize fabrication costs, all metal layers of ink jet print head 9, except orifice plate 76, are designed so that they may be fabricated using relatively inexpensive conventional photo-patterning and etching processes on metal sheet stock. Machining or other metal working processes, such as electropolishing or the like, are not required. The present invention is applicable to ink jet print heads 9 using a wide variety of inks. Inks that are liquid at room temperature, as well as inks of the phase change type which are Solid at room temperature, may be used. In operation, ink entering ink inlet 12, e.g., from ink supply 11 (FIG. 1), passes to ink supply manifold 16 as shown in FIG. 2. From ink supply manifold 16, ink flows through ink inlet channel 18, through ink inlet 20 and into ink pressure chamber 22. Ink exits ink pressure chamber 22 by way of ink pressure chamber outlet 24. Ink then flows through ink passage 26 to nozzle/outlet 14, characterized by an electropolished surface exhibiting a reduced density of surface defects, from which ink drops are ejected. A series of arrows 28 diagram this ink flow path.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

What is claimed is:

1. A method of treating an orifice plate of a drop-on-demand ink jet print head, the orifice plate having an ink-contacting surface, an opposed surface, and an orifice extending between them, comprising the step of:

electropolishing the ink-contacting surface of the orifice plate where the orifice extends into the orifice plate.

2. A method according to claim 1 wherein the surface of the orifice plate is electropolished in an electropolishing bath comprising a fluorinated surfactant.

3. A method according to claim 2 wherein the electropolishing bath comprises from about 20 ppm to about 50 ppm of a fluorinated surfactant.

4. A method according to claim 1 wherein only the ink-contacting surface of the orifice plate is electropolished.

5. A method according to claim 1 wherein substantially all of the ink-contacting surface of the orifice plate is electropolished.

6. A method according to claim 1 further comprising the step of electropolishing the surface of the orifice plate opposed to the ink-contacting surface.

7. A drop-on-demand ink jet print head having an array of ink jets for receiving ink from an ink supply and for ejecting drops of ink toward a print medium, comprising an ink ejection member characterized by an electropolished ink-contacting major surface.

8. A drop-on-demand ink jet print head according to claim 7 wherein the ink ejection member is an orifice plate through which an array of orifices extend in correspondence with the array of ink jets.

9. A drop-on-demand ink jet print head according to claim 7 wherein the electropolishing step is conducted in the presence of an amount of fluorinated surfactant effective to reduce surface defect density on the major surface of the ink ejecting member.

10. A method according to claim 9 wherein the electropolishing bath comprises from about 20 ppm to about 50 ppm of a fluorinated surfactant.

11. A drop-on-demand ink jet print head according to claim 7 wherein the ink ejection member includes an electropolished major surface opposite the electropolished ink-contacting major surface.

* * * * *

UNITED STATES PATENT AND TRADEMARK OFFICE

CERTIFICATE OF CORRECTION

PATENT NO. : 5,574,486

DATED : November 12, 1996

INVENTOR(S) : Maridana L. Whitlow, et. al.

It is certified that error appears in the above-indentified patent and that said Letters Patent is hereby corrected as shown below:

Title page, item [54], and col. 1, line 1, change "METHOS" to --METHOD--.

Signed and Sealed this

Third Day of June, 1997

*Attest:*

*Attesting Officer*

BRUCE LEHMAN

*Commissioner of Patents and Trademarks*